US007234238B2

(12) United States Patent
Wong

(10) Patent No.: US 7,234,238 B2
(45) Date of Patent: Jun. 26, 2007

(54) NAIL CLIPPER

(76) Inventor: Wai Yip Wong, Flat B, 11/Fl., Block 6, Classical Garden II, Tai Po, New Territories, Hong Kong (CN)

( * ) Notice: Subject to any disclaimer, the term of this patent is extended or adjusted under 35 U.S.C. 154(b) by 93 days.

(21) Appl. No.: 11/072,438

(22) Filed: Mar. 7, 2005

(65) Prior Publication Data

US 2006/0075639 A1 Apr. 13, 2006

(30) Foreign Application Priority Data

Oct. 13, 2004 (CN) ..... 2004 2 0118358 U

(51) Int. Cl.
*A45D 29/02* (2006.01)

(52) U.S. Cl. ..... 30/28; 30/175; 30/341; 132/75.5

(58) Field of Classification Search ..... 30/26–29, 30/123, 143, 175, 186, 341, 501; 132/75.5, 132/73.5, 75.4, 75.3, 75.6, 76.2, 76.4, 73; 7/162; D8/52, 99; D28/60–62, 56–57, 59
See application file for complete search history.

(56) References Cited

U.S. PATENT DOCUMENTS 741,709 A * 10/1903 Petrelli ..... 30/28
794,234 A * 7/1905 Casse ..... 30/28
843,383 A * 2/1907 Hosster ..... 30/28
860,975 A * 7/1907 Havell ..... 30/28
967,598 A * 8/1910 Bader ..... 132/75.5
1,394,727 A * 10/1921 Gronbech ..... 30/28
1,555,973 A * 10/1925 Hoge ..... 132/75.5
2,570,025 A * 10/1951 Davis ..... 30/28
2,616,436 A * 11/1952 Langley ..... 132/75.5
3,744,131 A * 7/1973 Manes ..... 30/28
5,392,518 A * 2/1995 Means ..... 30/28
5,617,633 A * 4/1997 Lee ..... 30/28
D446,886 S * 8/2001 Park ..... D28/62
D466,251 S * 11/2002 Park ..... D28/62
D468,865 S * 1/2003 Park ..... D28/60
6,557,259 B1 * 5/2003 Nguyen ..... 30/29
6,705,014 B2 * 3/2004 Park ..... 30/28
6,735,869 B2 * 5/2004 Lau ..... 30/28
D497,221 S * 10/2004 Yeung ..... D28/60
6,970,067 B1 * 11/2005 Sinke et al. ..... 340/5.65

FOREIGN PATENT DOCUMENTS

JP 03212206 * 9/1991
JP 2004313614 * 11/2004
WO WO-2006039840 * 4/2006

* cited by examiner

*Primary Examiner*—Jason Prone

(57) ABSTRACT

A nail clipper includes a body, an upper cutting part, a lower cutting part and a pressing piece. The body is a box shape which is open at the top and at the bottom near the front end, and has the lower cutting part at its front end and a sliding locking piece at its rear end. The sliding locking piece has a pulling button which protrudes outside the body. The upper cutting part is movably connected to the front end of the body and has an opening at its rear end. The pressing piece is movably connected through a pivot to the middle front part of the body and its rear end bends downwards and can hook onto the sliding locking piece.

4 Claims, 4 Drawing Sheets

NAIL CLIPPER

BACKGROUND OF THE INVENTION

The present invention relates to a nail clipper and more particularly pertains to a portable nail clipper as a tool for manicure and pedicure.

There are various technical proposals relating to nail clippers. Most of the nail clippers are inconvenient and dangerous to carry because their cutting edges do not bite together for storage. There are some nail clippers with the cutting edges biting together for storage. The simplest method is to provide a cap to cover the cutting edges, but it is easy to lose the cap. Attaching the cap onto the clipper body can avoid losing the cap but it hinders the use of the nail clipper. Another method is to add a cover plate which is connected to the clipper body. The cover plate is structured to press the pressing piece when folded for storage, thereby locking the cutting edges to a position that they bite together. Although this method is more practical, as the pressing piece is persistently pressed by the cover plate when folded for storage, prolonged use renders the pressing piece becoming deformed or losing elasticity and so the pressing piece cannot function eventually. In order for the nail clipper to be simple to use and for the cutting edges thereof to bite together for storage, many technical proposals require many parts and components, more complex assembling and higher production costs and are inconvenient to use. To nail clippers such goods for daily use which are small in size and easily lost and have to be discarded once the cutting edges become blunt, it is difficult for the market to widely accept nail clippers which are too expensive and complicated to use.

The prior art therefore cannot fully satisfy the demands of the consuming public. The market is still looking forward to a nail clipper which is safe and reliable, small in size, convenient to carry, easy to fold for storage, equipped with a durable pressing piece that does not deform and is susceptible of a low selling price.

BRIEF SUMMARY OF THE INVENTION

In view of the aforesaid disadvantages now present in the prior art, the present invention provides a nail clipper which is safe and reliable, small in size, convenient to carry, easy to fold for storage, equipped with a durable pressing piece that does not deform and is susceptible of a lower production cost.

To attain this, the present invention generally comprises a body, an upper cutting part, a lower cutting part and a pressing piece, wherein the body is in the shape of a box which is open at the top and is open at the bottom near the front end, and has the lower cutting part at its front end and a sliding locking piece at its rear end. The sliding locking piece is connected by a return spring to the rear end of the body and has a pulling button which protrudes outside the body and can bring along the sliding locking piece to slide inwards. The upper cutting part is movably and pivotably connected to the front end of the body and through a spring piece it is connected to and can bite with the lower cutting part. The position of the cutting edge at the front end of the upper cutting part corresponds to the position of the cutting edge at the front end of the lower cutting part. The upper cutting part has an opening at its rear end. The pressing piece is movably and pivotably connected through a pivot to the middle front part of the body, and a small elongated hole is opened at the connecting position on each of the left and right sides of the pressing piece for the pivot to pass through. The bottom of the pressing piece is connected to one end of a spring, and the other end of which is connected to the pivot. The front end of the pressing piece is inserted into the opening at the rear end of the upper cutting part, and the rear end of the pressing piece bends downwards and can hook onto the sliding locking piece at the rear end of the body.

A recess is disposed near the front end at the bottom of the pressing piece, and the opening at the rear end of the upper cutting part forms a plane bending downwards which is substantially vertical or at an angle in relation to the top of the upper cutting part, and the opening can interlock with the recess.

An emery board is disposed near the rear end at the bottom of the body for trimming nail edges.

A hanging piece which is hollow in the middle is disposed at the rear end of the body so that the whole nail clipper can be hanged and kept securely.

When the present invention is not in use, the rear end of the pressing piece is hooked onto the sliding locking piece at the rear end of the body so that the rear end of the pressing piece is locked at the rear end of the body. Since the rear end of the pressing piece is locked in a downward position and its front end inserts into the opening at the rear end of the upper cutting part, the upper cutting part is also locked in a downward position at the same time. The cutting edges of the upper cutting part and the lower cutting part are thereby locked in a state that they bite together. The nail clipper therefore becomes a small and flat box-shaped object which is convenient to carry. The secure locking construction also allows users to carry the nail clipper in a safe and reliable manner.

To use the present invention, the user may first slightly pulls the pulling button forwards so that the return spring comes into a compressed state and brings along the sliding locking piece to slide inwards. The rear end of the pressing piece is no longer locked and therefore springs upwards. As the rear end of the pressing piece springs upwards, its front end then moves downwards. Since the front end of the pressing piece is inserted into the opening at the rear end of the upper cutting part, the downward-bending plane of the opening interlocks with the recess and thus triggers to move the upper cutting part upwards. The cutting edges of the upper cutting part and the lower cutting part thereby separate from each other. As the user presses near the rear end of the pressing piece, the upper cutting part moves downwards and the cutting edges of the upper cutting part and the lower cutting part bite together. The user repeatedly presses near the rear end of the pressing piece and through the spring piece the upper cutting part and the lower cutting part movably bite together and separate in sequence. As a result, the object of nail clipping is attained. The operation is easy and it is simple to use.

After finishing clipping, the user may slightly pull the rear end of the pressing piece, and the downward-bending plane of the opening will immediately separate from the recess. The user may then press the rear end of the pressing piece downwards and hook it onto the sliding locking piece at the rear end of the body. The rear end of the pressing piece is then locked at the rear end of the body, thereby folding the nail clipper into a flat and small box-shaped object. The operation is fast and easy.

It is an object of the present invention to provide a nail clipper which is small in size, convenient to carry, easy to use and is easy to fold up for storage.

It is another object of the present invention to provide a nail clipper which is equipped with secure locking structure which enables users to carry the nail clipper in a safe and reliable manner.

It is also another object of the present invention to provide a nail clipper which is simple in construction with not many parts and components and is therefore easy to assemble.

It is yet another object of the present invention to provide a nail clipper with a durable pressing piece which does not deform.

It is a further object of the present invention to provide a nail clipper which is susceptible of a low production cost and satisfies the demands of the consuming public, thus overcoming the disadvantages of prior art.

DETAILED DESCRIPTION OF THE INVENTION

Figure 1:
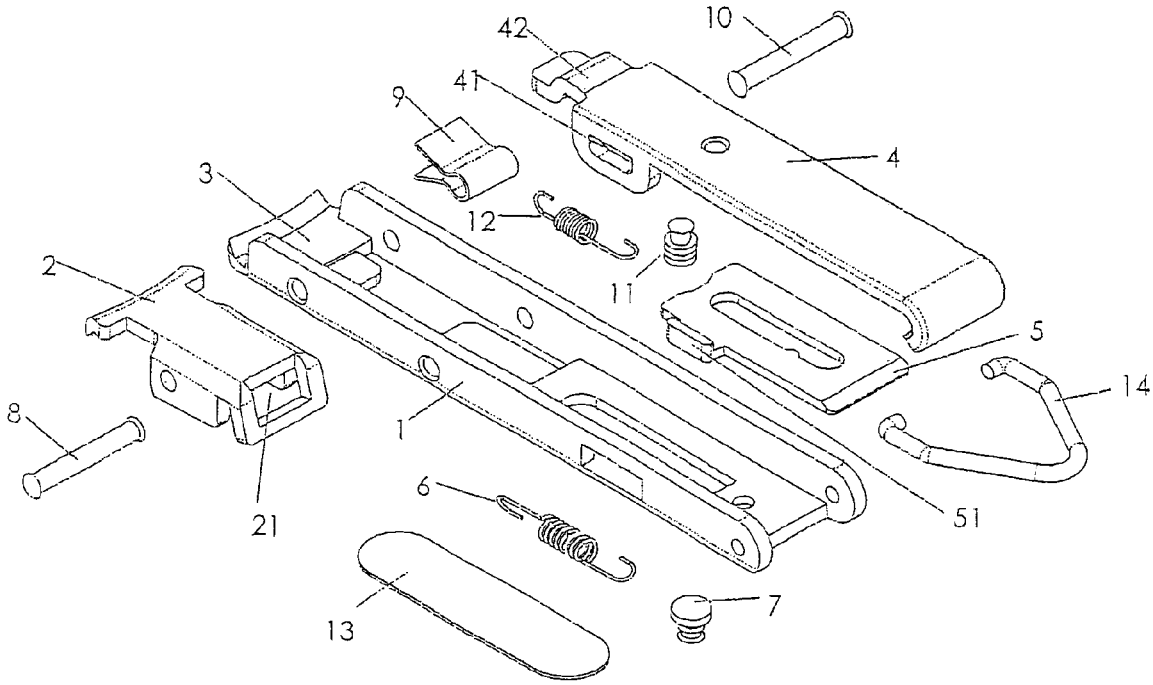
FIG. 1 shows the exploded view of the present invention.
Figure 2:
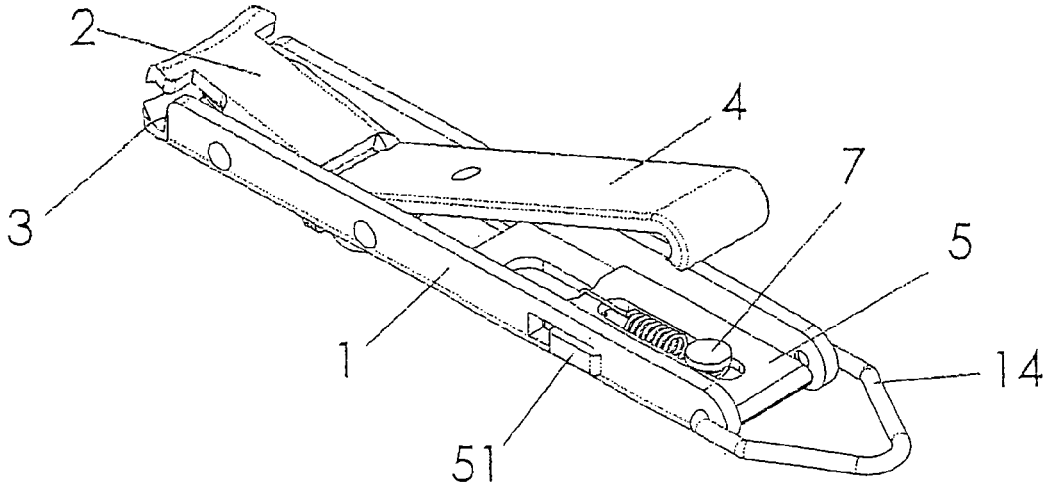
FIG. 2 shows the perspective view of the present invention while in use.
Figure 3:
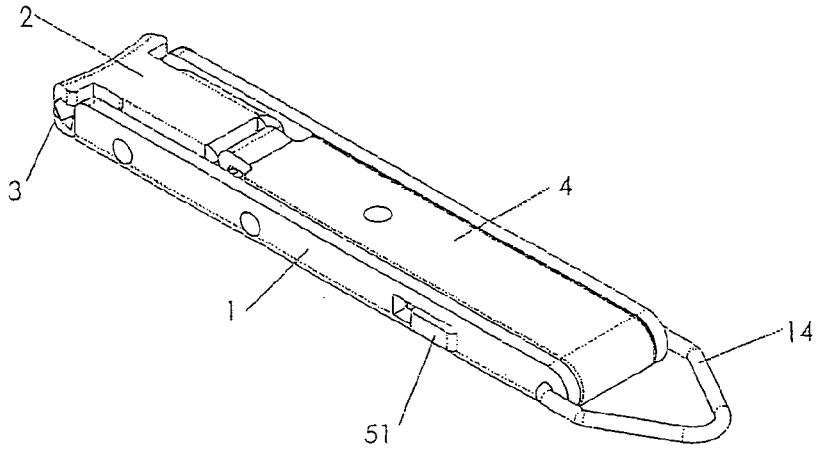
FIG. 3 shows the perspective view of the present invention when folded up.

As illustrated in FIGS. 1 to 3, the nail clipper comprises a body 1, an upper cutting part 2, a lower cutting part 3 and a pressing piece 4.

The body 1 is in the shape of a box which is open at the top and is open at the bottom near the front end, and has the lower cutting part 3 at its front end and a sliding locking piece 5 at its rear end.

The sliding locking piece 5 is connected by a return spring 6 and a peg 7 to the rear end of the body 1 and has a pulling button 51 which protrudes outside the body 1 and can bring along the sliding locking piece 5 to slide inwards.

The upper cutting part 2 is movably connected to the front end of the body 1 through a pivot 8, and through a spring piece 9 it is connected to and can bite with the lower cutting part 3. The position of the cutting edge at the front end of the upper cutting part 2 corresponds to the position of the cutting edge of the lower cutting part 3, and the upper cutting part 2 has an opening 21 at its rear end.

The pressing piece 4 is movably connected through a pivot 10 to the middle front part of the body 1, and a small elongated hole 41 is opened at the connecting position on each of the left and right sides of the pressing piece 4 for the pivot 10 to pass through. The bottom of the pressing piece 4 is connected through a peg 11 to one end of a spring 12 and the other end of which is connected to the pivot 10. The front end of the pressing piece 4 is inserted into the opening 21 at the rear end of the upper cutting part 2.

A recess 42 is disposed near the front end at the bottom of the pressing piece 4, and the opening 21 at the rear end of the upper cutting part 2 forms a plane bending downwards which is substantially vertical or at an angle in relation to the top of the upper cutting part 2, and the opening 21 can interlock with the recess 42.

The rear end of the pressing piece 4 bends downwards and can hook onto the sliding locking piece 5 at the rear end of the body 1.

An emery board 13 is disposed near the rear end at the bottom of the body 1.

A hanging piece 14 which is hollow in the middle is disposed at the rear end of the body 1.

Figure 4:
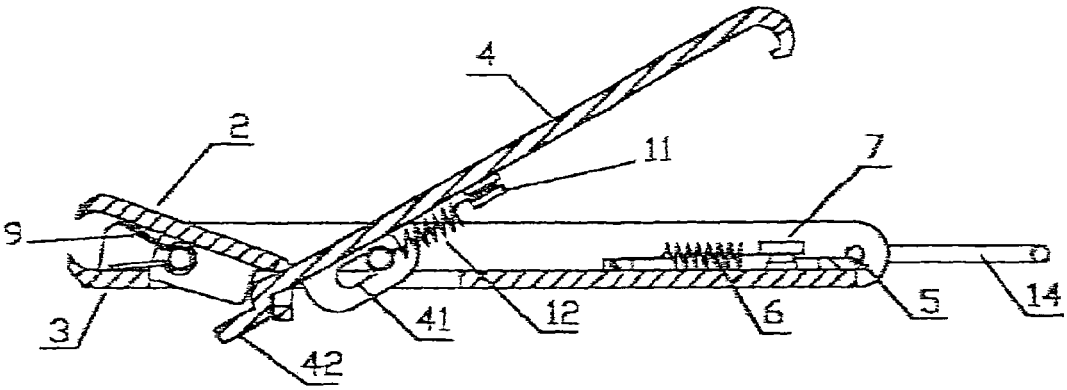
FIG. 4 shows the cross-sectional view of the present invention while in use.

As illustrated in FIGS. 2 and 4, to use the nail clipper, the user may first slightly pull the pulling button 51 forwards so that the return spring 6 comes into a compressed position and brings along the sliding locking piece 5 to slide inwards. The rear end of the pressing piece 4 is no longer locked and springs upwards. As the rear end of the pressing piece 4 springs upwards, its front end then moves downwards. Since the front end of the pressing piece 4 is inserted into the opening 21 at the rear end of the upper cutting part 2, the downward-bending plane of the opening 21 interlocks with the recess 42 and thus triggers to move the upper cutting part 2 upwards. The cutting edges of the upper cutting part 2 and the lower cutting part 3 thereby separate from each other. As the user presses near the rear end of the pressing piece 4, the upper cutting part 2 moves downwards and the cutting edges of the upper cutting part 2 and the lower cutting part 3 bite together. The user repeatedly presses near the rear end of the pressing piece 4 and through the spring piece 9 the upper cutting part 2 and the lower cutting part 3 movably bite together and separate in sequence. As a result, the object of nail clipping is attained. The emery board 13 can be used to trim nail edges after finishing nail clipping.

Figure 5:
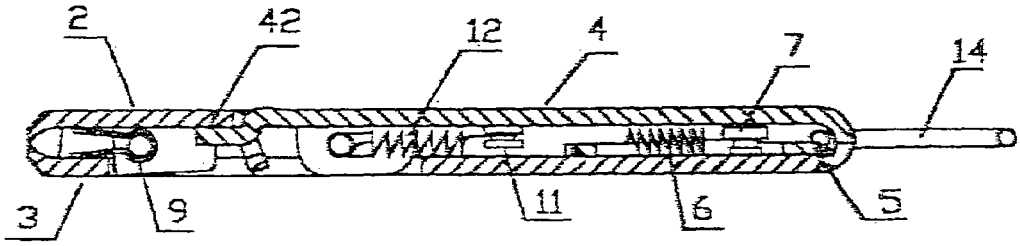
FIG. 5 shows the cross-sectional view of the present invention when folded up.
Figure 6:
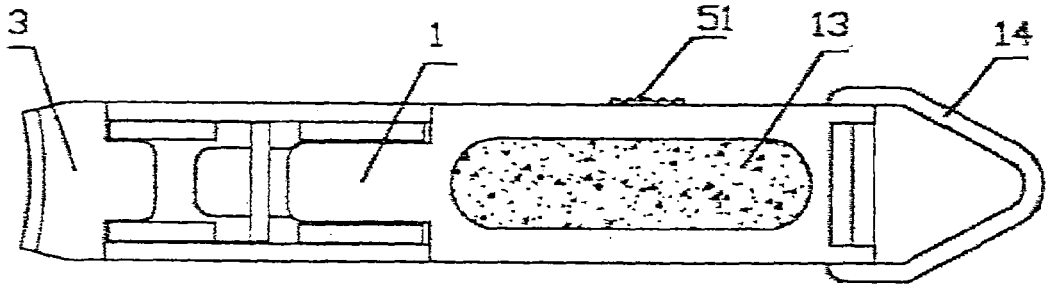
FIG. 6 shows the bottom view of the present invention when folded up.

As illustrated in FIGS. 5 and 6, after finishing clipping, the user may slightly pull the rear end of the pressing piece 4, and the downward-bending plane of the opening 21 will immediately separate from the recess 42. The user may press the rear end of the pressing piece 4 downwards and hook it onto the sliding locking piece 5 at the rear end of the body 1. The rear end of the pressing piece 4 is then locked at the rear end of the body 1. Since the rear end of the pressing piece 4 is locked in a downward position and its front end inserts into the opening 21 at the rear end of the upper cutting part 2, the upper cutting part 2 is also locked in a downward position at the same time. The cutting edges of the upper cutting part 2 and the lower cutting part 3 are thereby locked in a state that they bite together. The nail clipper then becomes a small and flat box-shaped object. When the user carries the nail clipper, the hanging piece 14 can be used to hang the nail clipper onto other objects. The hanging piece 14 can also be used as a key ring.

As to a further discussion of the manner of usage and operation of the present invention, the same should be apparent from the above description. Accordingly, no further discussion relating to the manner of usage and operation is provided.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

The present invention is capable of other embodiments and of being practiced and carried out in various ways. It is to be understood that the phraseology and terminology employed herein are for the purpose of description and should not be regarded as limiting.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

What is claimed is:

1. A nail clipper comprising a body, an upper cutting part with a cutting edge at a front end thereof, a lower cutting part with a cutting edge at a front end thereof, and a pressing piece, wherein the body has a top, a bottom, a front end and a rear end, and the body is in a box shape which is open at the top of the body and is open at the bottom of the body near the front end of the body, and the body has the lower cutting part at the front end thereof and a sliding locking piece at the rear end thereof;

the sliding locking piece is connected by a return spring to the rear end of the body and has a pulling button which protrudes outside the body, and the pulling button brings along the sliding locking piece to slide inwards;

the upper cutting part is movably and pivotably connected to the front end of the body, and the upper cutting part is connected to and bites with the lower cutting part through a spring piece, and the cutting edge of the upper cutting part corresponds to the cutting edge of the lower cutting part in terms of position, and the upper cutting part has an opening at a rear end thereof;

the pressing piece having a bottom, a left side and a right side is movably and pivotably connected through a pivot to a middle front part of the body, and a small elongated hole is opened at a connecting position on each of the left and right sides of the pressing piece for the pivot to pass through, and the bottom of the pressing piece is connected to one end of a spring and another end of the spring is connected to the pivot, and a front end of the pressing piece is inserted into the opening at the rear end of the upper cutting part, and a rear end of the pressing piece bends downwards and hooks onto the sliding locking piece at the rear end of the body when the nail clipper is not in use.

2. A nail clipper as in claim 1, wherein a recess is disposed near the front end at the bottom of the pressing piece, and the opening at the rear end of the upper cutting part forms a plane bending downwards which is substantially vertical or at an angle in relation to a top of the upper cutting part, and the opening interlocks with the recess.

3. A nail clipper as in claim 1, wherein an emery board is disposed near the rear end at the bottom of the body.

4. A nail clipper as in claim 1, wherein a hanging piece which is hollow in middle is disposed at the rear end of the body.

* * * * *